United States Patent [19]

Cloup

[11] Patent Number: 4,756,329

[45] Date of Patent: Jul. 12, 1988

[54] DEVICES FOR THE INJECTION OF AN ADDITIVE PRODUCT METERED INTO A MAIN FLUID

[76] Inventor: Jean Cloup, Beaugey Carignan, 33360 Latresne, France

[21] Appl. No.: 80,390

[22] Filed: Jul. 28, 1987

[30] Foreign Application Priority Data

Jul. 31, 1986 [FR] France ..... 86 11122

[51] Int. Cl.[4] ..... G05D 11/03

[52] U.S. Cl. ..... 137/99; 91/224; 91/229; 91/347; 417/403

[58] Field of Search ..... 137/99; 417/403; 91/224, 229, 347

[56] References Cited

U.S. PATENT DOCUMENTS

| | | | |
|---|---|---|---|
| Re. 29,193 | 4/1977 | Carlyle | 137/99 |
| 3,937,241 | 2/1976 | Cloup | 137/99 |
| 4,436,494 | 3/1984 | Yamaizumi | 417/403 |
| 4,558,715 | 12/1985 | Walton | 137/99 |

*Primary Examiner*—Robert G. Nilson

*Attorney, Agent, or Firm*—Murray and Whisenhunt

[57] ABSTRACT

The invention relates to a device for injecting a metered product into a main circulation of liquid, comprising a metering piston (28) coupled to a stepped piston (11) whose motion results from the pressure of the main fluid in a known manner. The piston (28) interacts with a metering cylinder (10) which is in permanent communication with the lower part of the liquid outlet chamber (8). The mixture of the products is thus confined to the outlet of the device, while no leakproof sliding of a component on contact with either of the liquid and product is necessary, and this eliminates the risks of abrasion of the seals due to deposits on the sliding component. In addition, since the inlet chamber (6) for the main liquid is annular, it permits a filter (33) to be easily installed.

8 Claims, 1 Drawing Sheet

DEVICES FOR THE INJECTION OF AN ADDITIVE PRODUCT METERED INTO A MAIN FLUID

Figure 1:
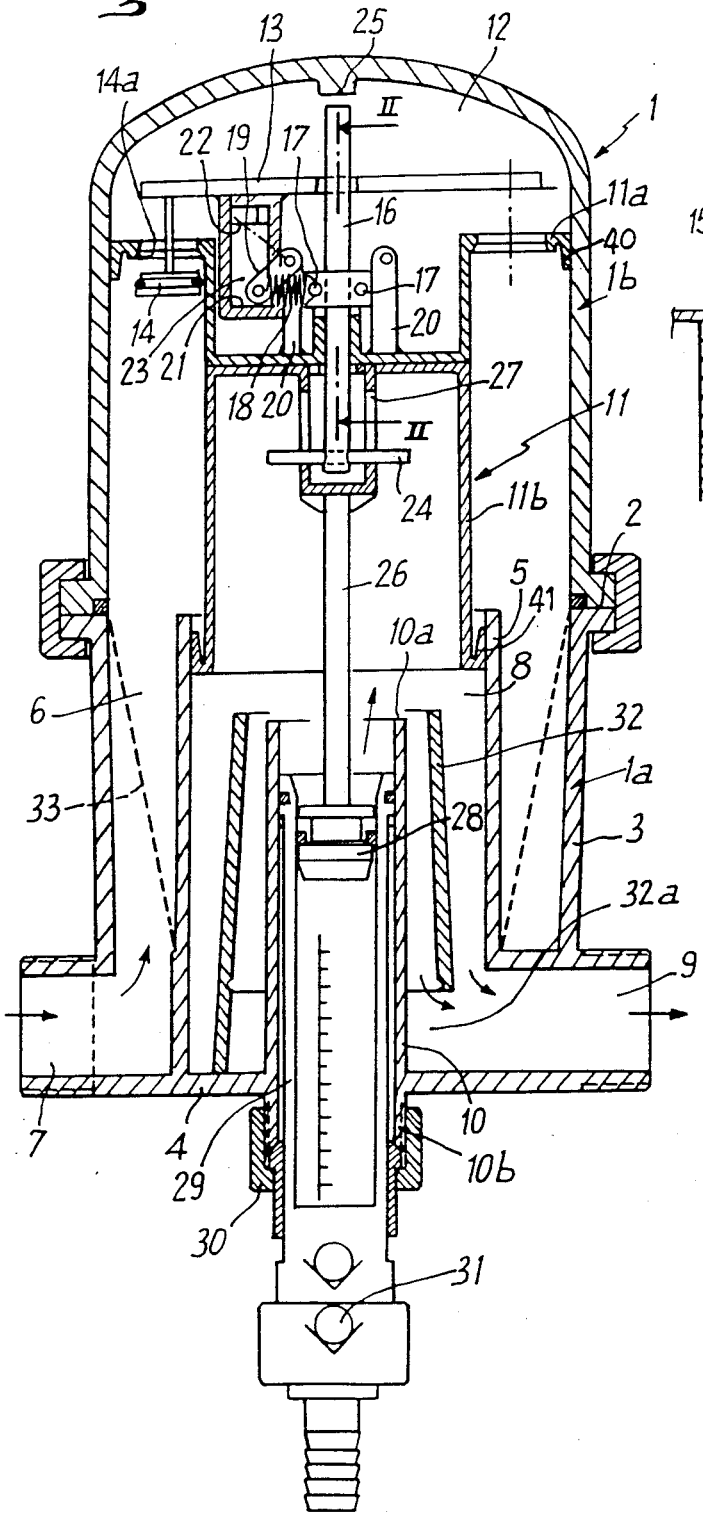

The present invention relates to a device for injecting a metered quantity of product into a main stream of fluid.

There are many known devices forming metering pumps in which the energy supplied to the pumping mechanism originates from the flow of the main liquid under pressure. Such devices, described particularly in U.S. Pat. Nos. 3,937,241 and 4,060,351, comprise, in an enclosure, a stepped piston which is mounted slidably along two cylindrical walls of different diameters which form part of the enclosure, which thus defines three chambers of variable volume. A mechanism with valves which is carried by the piston enables the fluid pressure to be applied to either face of the stepped piston, which thus describes a reciprocating motion and which forms the driving member for a metering piston interacting with a cylinder in communication with a storage vessel of the product to be injected. The mechanism with valves is itself manoeuvred by a transmission which is controlled by a pushrod activated by stops which are stationary at the top and bottom dead centres of the stepped piston. The transmission is such that the valves are held in each of their positions in a stable manner.

One of the problems which are encountered when making use of these devices lies in the fact that the additive product is generally introduced into the main circuit at the inlet of the pump and that it thus circulates in the three chambers. Corrosion phenomena can then arise because of the frequently corrosive nature of the product, and these shorten the lifetime of the pump components. Furthermore, in the case of certain additive products, such as liquid bleach, it has been found that chemical reactions with the main liquid (particularly water) or the salts which it contains in solution result in precipitates or deposits in the mixing zone whose formation must be prevented or at least limited, and everything possible must be done to prevent such deposits forming on components involving sealed sliding. In fact, these deposits constitute extremely active abrasive agents which quickly destroy the quality of the leakproof sliding contact between two components or seals arranged where a moving component passes through walls.

Such problems are encountered particularly with devices of the type of those described in U.S. Pat. No. 4,558,715 which, in attempting to establish an injection of product at the outlet of the pump, propose a slidably mounted rod connecting the stepped piston to the metering piston, made leakproof by a seal, through a stationary wall, the rod being alternately in contact with the main liquid and the product and thus forming the preferred support for the formation of accretions which quickly break down the seal.

The present invention forms another solution to the problem of the injection of product at the outlet of a device in order to protect the moving parts of the pump against corrosion while making it possible to avoid the formation of deposits on other sliding parts which is just as detrimental to satisfactory long-term behaviour of the equipment. The improvement according to the invention is also designed so as to make the maintenance of this equipment easier by making the assembly and disassembly, and hence the maintenance interventions, extremely simple.

To this end, therefore, the invention relates to an improvement to devices for the injection of a metered quantity of an additive product into a liquid proportionately to its flow rate, consisting of a closed cylindrical enclosure comprising a liquid inlet opening, and outlet opening for this liquid and an inlet opening for the additive product, and an inner cylindrical wall, concentric with the cylindrical wall of the enclosure, by means of a stepped piston mounted so as to slide to and fro along the abovementioned cylindrical walls, dividing the enclosure into three chambers of variable volume, namely an annular first chamber bounded by the two walls and the piston, an upper second chamber bounded by the large-diameter cylindrical wall and the corresponding part of the piston, and a third chamber bounded by the small-diameter cylindrical wall and the corresponding part of the piston, by means of a device with valves which is mounted on the piston to bring the second chamber into alternate communication with one and the other of the other two chambers while isolating it from the other, and by means of at least one metering piston coupled to the stepped piston and mounted slidably in a metering cylinder parallel to the axis of the stroke of the stepped piston.

According to one of the main characteristics of the invention, this improvement lies in that the first chamber, known as the inlet chamber, is in permanent communication with the fluid inlet opening, the third chamber, known as the outlet chamber, is in permanent communication with the fluid outlet opening and with the inlet opening for the additive product, while the metering piston is coupled to the stepped piston by a rod parallel to the stroke of the stepped piston and extending freely through the outlet chamber and through the inlet opening for the additive product consisting of the outlet of the metering cylinder into the bottom of the enclosure adjacent to the abovementioned third chamber.

To make it possible to regulate in a simple manner the quantity of product to be injected, the metering cylinder is provided with an inner liner whose axial position in the metering cylinder can be adjusted in relation to the stroke of the metering piston so as to form a member for adjusting the working stroke of the piston and of the quantity metered out.

The metering cylinder is preferably situated partly projecting inside the third chamber, above the level of the outlet opening, a removable wall being arranged in the annular space of the third chamber, bounded by the said projection and the abovementioned inner cylindrical wall to form a baffle against the flow of the fluid to which the product has been added.

This structural design makes it advantageously possible to fit a removable filter element between the two cylindrical walls of the enclosure.

Lastly, it will be noted, insofar as this embodiment is concerned, that the abovementioned device with valves consists of at least one first valve interacting with a seat arranged in the wall of the stepped piston separating the first and second chambers and opening into the first chamber parallel to the axis of the stroke of the piston, of at least one second valve interacting with a seat arranged in the piston wall separating the second from the third chamber and opening into the abovementioned second chamber, and of a linkage connecting the valves which is situated in the second chamber and coupled to the piston by a bistable mechanism for transmitting the motion of an axial pushrod mounted slidably in the piston and interacting with stops at the top and bottom dead centres of the stroke of the stepped piston.

The cylindrical enclosure consists of two separable parts assembled together in the region of the median part of the enclosure. In its regions of contact with the walls of the enclosure, the piston has sealing lips extending in each other's direction.

The invention will be understood better from the description which is given below by way of an example which is purely for guidance, without any limitation being implied, which will enable its advantages and secondary features to be seen more clearly.

Figure 2:
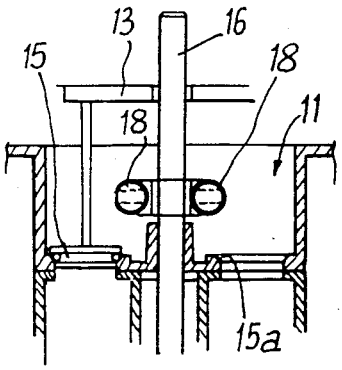

Reference will be made to the attached drawings, in which:

FIG. 1 is a diagrammatic sectional view of a first embodiment of the device according to the invention, FIG. 2 is a partial section along the line II—II of FIG. 1.

Referring to FIG. 1 first, this shows a pump body 1 comprising a lower first part 1*a* associated with a bell-shaped upper second part 1*b* to form a substantially cylindrical enclosure closed in a leakproof manner at a substantially median joint plane 2. The lower part 1*a* comprises a cylindrical outer wall 3 closed by a bottom 4 in the middle of which an inner cylindrical wall 5 stands concentrically with the wall 3. The annular space 6 defined by the walls 3 and 5 is communication with an opening 7 forming a connecting branch for a delivery line for the main fluid, which is not shown, while the inner space 8 at the wall 5 is in permanent communication with a connecting branch 9 for a fluid outlet line. A tubular third wall 10 rises from the bottom 4 inside the space 8, and is substantially coaxial with the walls 3 and 5. The tube 10 opens directly into the space 8 by means of its upper end, while being extended by means of its lower end 10*b* beyond the bottom 4 in order to be connected to a delivery line for the additive product which will be described below in greater detail.

The bell 1*b* defines a cylindrical bearing whose internal diameter is identical to that of the wall 3, for the large-diameter part 11*a* of a stepped piston 11. The piston 11 thus has a small-diameter lower part 11*b* which can slide along the wall 5. This part 11*b* is in the shape of an inverted bell which closes the space 8 inside the wall 5. The part 11*a* closes, with the part 11*b*, the annular space 6 and forms, together with the bell 1*b*, an upper chamber 12. Thus, the space 6, the chamber 12 and the space 8 form three chambers of variable volume, the first, second and third chambers respectively, inside the enclosure 1. The chamber 6 is in permanent communication with the inlet 7 for the main fluid, the chamber 8 is in permanent communication with the fluid outlet 9 and with the delivery opening 10*a* for the additive product, while the chamber 12 is in selective communication sometimes with the chamber 8 and sometimes with the chamber 6 by means of a system of valves carried by the piston 11.

This system of valves, shown partially in FIGS. 1 and 2, essentially comprises a movable linkage 13 carrying, for example, eight valves, four of which, such as 14, interact with seats such as 14*a* arranged in the wall of the piston separating the chamber 6 from the chamber 12, and four, such as 15, interacting with seats 15*a* arranged in the piston wall separating the chamber 12 from the chamber 8. The valves 14 open downwards, that is to say into the chamber 6, whereas the valves 15 open upwards, that is to say into the chamber 12. The linkage 13 can travel between a first position away from the top of the piston, in which the valves 14 are resting on their seats 14*a*, the chamber 6 being isolated from the chamber 12, and the valves 15 are at a distance from their seats 15*a*, placing the chamber 12 in communication with the chamber 8, and a second position closer to the top of the piston, in which the valves 14 are open to connect the chamber 12 to the chamber 6 and the valves 15 are closed to isolate the chamber 12 from the chamber 8. The changeover of the linkage 13 from one position to the other and its maintenance in either of these is produced by a bistable transmission mechanism extending between the linkage and a central pushrod 16 coaxial with the piston and mounted slidably in the latter. To this end, the pushrod 16 has coupling pivots 17 for springs 18 whose other end is fixed to a lever 19 articulated by a free end to a support 20 fixed to the piston 11. The end of the lever 19 which is coupled to the spring 18 can travel between two stops 21 and 22 arranged to be the lower upper surfaces of a window 23 in the linkage 13. The spring 18 tends to bring the lever 19 closer to the pushrod 16 and thus to bring the linkage 13 closer to the top of the piston 11 by making the lever 19 bear on the stop surface 21 or to move it away by making the lever 19 bear on the stop surface 22. At its lower end, the pushrod 16 is equipped with a transverse bar 24 which can bear on the end 10*a* of the tubular end piece 10 when the piston reaches its bottom dead centre. The pushrod 16 interacts, by means of its other end, with a stop surface 25 at the bottom of the bell 1*b*, when the piston 11 reaches its top dead centre.

Thus, when the piston moves down the valves 14 are open and the valves 15 are closed, as shown in FIG. 1.

The fluid allowed to enter the chamber 6 reaches the chamber 12 which it "inflates", pushing the piston 11 back downwards. When the bar 24 is stopped by the end 10*a* of the tube 10, the pushrod 16 is stopped while the piston 11 continues its decent. The articulation of the levers 19 to the support 20 then passes under the coupling point 17 of the springs 18 to the pushrod. The springs 18 then cause the levers 19 to tilt and leave the stop 21 to hit the stop 22 and lift the linkage 13, until the valves 14 have been closed and the valves 15 have been opened. The fluid allowed to enter chamber 6 then acts on the annular lower surface of the large-diameter part 11*a* of the piston 11 and makes it rise again. The fluid held in the chamber 12 then escapes into the chamber 8 and through the outlet orifice 9 in the proportion of the differential volumes swept by the large-diameter and the small-diameter parts of the piston. In the vicinity of the top dead centre, the pushrod 16 hits the stop 25 and the articulation of the levers 19 on the supports 20 passes again above the articulations 17, causing these levers to tilt downwards and causing the corresponding motion of the linkage which returns to its position which is shown in the figure. The piston 11 can then recommence a second cycle, with the downward phase causing the liquid held in the chamber 8 to be expelled through the opening 9.

A metering piston 28 which slides in the tube 10 or, more precisely, in an inner liner 29 of the tube 10, is coupled to the stepped piston 11 by means of a conecting rod 26 and a lantern barrel 27 in which the pushrod 16 and its bar 24 can travel. This liner 29 is fastened to the tube 10 by means of a leakproof connecting device 30 which enables its axial position to be adjusted in relation to the tube. This liner is itself connected to a delivery line for the additive product, not shown, and has a box containing valves 31 permitting the product to be sucked in to travel in the direction of the enclosure 1. The piston 28 is such that when it moves down into the liner 29, an annular clearance is formed between it and the liner enabling the product situated below to pass above the piston. On the other hand, during the reverse stroke, the sliding of the piston 28 is leakproof and the product under the piston 28 is sucked in through the valves 31, at the same time as a transfer of the product into the chamber 8 takes place through the end 10*a* of the tube 10.

Since the stroke of the piston 28 is, as a result of its construction, constant in amplitude, the adjustment of the metered quantity which is sucked in and then injected is produced by moving the liner 29 along the tube to adjust the length of the piston stroke during which it is in contact with the liner 29. For this purpose, the latter may be graduated externally, displaying the volume of the adjusted metered quantity.

As has been seen above, at each stroke of the piston 11 a quantity of main liquid is propelled in the direction of the outlet opening 9. In the chamber 8 there is therefore a stream of liquid directed downwards. When the piston 11 rises towards its top dead centre, the metering piston 28 injects into the chamber 8 the metered quantity of additive product which is directed directly towards the lower part of this chamber, around the tube 10 and is driven towards the outlet 9. It is therefore in this region that the mixture of the main fluid and the additive product is produced and, consequently, it is to this region that the risks of deposits or accretions resulting from the reaction between the two products are confined.

It is, then, advantageous to provide, in this cylindrical volume, for fitting a removable wall 32 resting on the bottom 4 of the enclosure and comprising in its base at least one opening 32*a* forming an outlet. This wall forms a component which offers the largest surface of contact to the fluid being mixed and which favours the attachment of a possible deposit. It can be seen that, since the enclosure is made of two easily separable parts, it is easy to withdraw this partition 32 either to clean it or replace it. This withdrawal also produces the breakdown and the disintegration of the deposit which can affect the neighbouring walls, and that itself can also be readily removed.

Also to be noted in this figure is the presence of a filter element 33 installed in a removable manner in the annular chamber 6, permitting impurities conveyed by the main fluid to be retained before passing through the device; this filter 33 is also very accessible.

Lastly, an advantageous arrangement resulting from the arrangement of the chambers according to the invention and from the direction of travel of the fluid, concerning the piston 11, will be noted. The figure shows, in fact, that at its large-diameter end 11*a*, the piston 11 has a lip 40 and at its small-diameter end 11*b* it has a lip 41. Since the fluid is allowed to enter the chamber 6, that is to say between the lips 40 and 41, the latter can only perform their function if they extend towards each other. This arrangement permits greater safety where the assembly and disassembly operations on the equipment are concerned, eliminating the risks of damage to the lips if they were found on the other side, by the free edges of the walls 1 and 5.

The invention finds an advantageous application in the field of metering pumps and devices for the treatment of a main fluid with an additional product.

I claim:

1. In a device for the injection of a metered quantity of an additive product into a liquid proportionately to its flow rate, the device comprising a closed enclosure including a large-diameter cylindrical wall, a bottom and an inlet opening for the liquid, an outlet opening for the liquid and an inlet opening for the additive product, and an inner small-diameter cylindrical wall, concentric with the cylindrical wall of the enclosure, the device also comprising a stepped piston mounted so as to slide to and fro along the above-mentioned cylindrical walls, dividing the enclosure into three chambers of variable volume namely an annular first chamber bounded by the two walls and the piston, an upper second chamber bounded by the large-diameter cylindrical wall and the corresponding part of the piston, and a third chamber bounded by the small-diameter cylindrical wall and the corresponding part of the piston, the device further comprising an arrangement with valves which is mounted on the piston to bring the second chamber into alternate communication with one and the other of the other two chambers while isolating it from the other chamber, at least one metering piston coupled to the stepped piston and mounted slidably in a metering cylinder parallel to the axis of the stroke of the stepped piston, the improvement consisting in that the first chamber, which is an inlet chamber, is in permanent communication with the inlet opening for the liquid, the third chamber, which is an outlet chamber, is in permanent communication with the outlet opening for the liquid and with the inlet opening for the additive product, while the metering piston is coupled to the stepped piston by means of a rod parallel to the stroke of the stepped piston and extending freely through the outlet chamber and through the inlet opening for the additive product formed by the outlet of the metering cylinder in the bottom of the enclosure adjacent to said third chamber.

2. A device according to claim 1, wherein the metering cylinder is provided with an inner liner whose axial position in the metering cylinder is adjustable in relation to the stroke of the metering piston so as to form a member for adjusting the working stroke of the piston and of the quantity metered out.

3. A device according to claim 1 wherein the metering cylinder is substantially coaxial with the cylindrical walls of the enclosure.

4. A device according to claim 3, wherein the metering cylinder is situated partially projecting into the third chamber above the level of the outlet opening, a removable wall being arranged in the annular space of the third chamber, bounded by the said projection and the above-mentioned inner cylindrical wall to form a baffle against the flow of the liquid to which the product has been added.

5. A device according to claim 3, wherein said first chamber comprises a removable filter element arranged between the two cylindrical walls.

6. A device according to claim 3, wherein said arrangement with valves comprises at least one first valve interacting with a seat arranged in the wall of the stepped piston separating the first and second chambers and opening into the first chamber parallel to the axis of the stroke of the piston, at least one second valve interacting with a seat arranged in the piston wall separating the second from the third chamber and opening into the above-mentioned second chamber, and a linkage connecting the valves which is situated in the second chamber and coupled to the piston by a bistable mechanism for transmitting the motion of an axial pushrod mounted slidably in the piston and interacting with stops at the top and bottom dead centres of the stroke of the stepped piston.

7. A device according to claim 1, wherein the enclosure is in two parts which can be separated axially substantially in the region of the median part of the outer cylindrical wall.

8. A device according to claim 1, wherein said stepped piston comprises sealing lips facing the sliding cylindrical walls which extend in each other's direction.

* * * * *